US008496017B2

(12) United States Patent
Haddad

(10) Patent No.: US 8,496,017 B2
(45) Date of Patent: Jul. 30, 2013

(54) SURVIVAL WALKING STICK

(76) Inventor: Richard Y. Haddad, Upper St. Clair, PA (US)

( * ) Notice: Subject to any disclaimer, the term of this patent is extended or adjusted under 35 U.S.C. 154(b) by 250 days.

(21) Appl. No.: 12/963,268

(22) Filed: Dec. 8, 2010

(65) Prior Publication Data

US 2011/0139201 A1 Jun. 16, 2011

Related U.S. Application Data

(60) Provisional application No. 61/285,611, filed on Dec. 11, 2009.

(51) Int. Cl.
*A45B 3/00* (2006.01)
*A45B 9/02* (2006.01)

(52) U.S. Cl.
USPC ..... 135/66; 135/76

(58) Field of Classification Search
USPC ..... 135/65, 66, 76, 72, 73; 124/17, 20.1, 124/29, 41.1; D22/106; D21/301, 570; 446/473, 446/26
See application file for complete search history.

(56) References Cited

U.S. PATENT DOCUMENTS

| | | | | |
|---|---|---|---|---|
| 2,823,483 | A * | 2/1958 | Malott | 43/19 |
| 3,154,063 | A * | 10/1964 | White | 124/20.2 |
| 3,304,946 | A * | 2/1967 | Lutes | 135/69 |
| 3,572,311 | A * | 3/1971 | Baer | 124/20.1 |
| 4,407,318 | A * | 10/1983 | Stuever | 135/66 |
| 4,805,583 | A * | 2/1989 | Mosser | 124/20.1 |
| 4,852,543 | A * | 8/1989 | Mosser | 124/20.1 |
| 5,887,577 | A * | 3/1999 | Sherrill | 124/20.1 |
| 6,957,492 | B1 * | 10/2005 | Westfall | 30/151 |
| 2002/0116768 | A1 * | 8/2002 | Grassi | 7/158 |
| 2004/0060587 | A1 * | 4/2004 | Morosini et al. | 135/66 |
| 2005/0211284 | A1 * | 9/2005 | Dooley | 135/65 |

FOREIGN PATENT DOCUMENTS

CA 2279597 A1 * 2/2000

* cited by examiner

*Primary Examiner* — David Dunn
*Assistant Examiner* — Danielle Jackson
(74) *Attorney, Agent, or Firm* — The Webb Law Firm

(57) ABSTRACT

A walking stick has a shaft and a hand guard at one end of the shaft, the hand guard being detachedly secured to the shaft so that it can be removed, inverted, and reattached. The hand guard has a yoke shape with two arms with spaced apart ends for receiving an elastic band therebetween. The hand guard is positionable with the arms of the yoke extending away from the shaft so as to comprise a slingshot.

8 Claims, 6 Drawing Sheets

SURVIVAL WALKING STICK

CROSS-REFERENCE TO RELATED APPLICATIONS

This application claims the benefit of priority from U.S. Provisional Patent Application No. 61/285,611, filed Dec. 11, 2009, which is incorporated herein by reference.

BACKGROUND OF THE INVENTION

1. Field of the Invention

This invention is directed to an improved walking stick that has associated therewith certain features that would provide the user assistance if, for example, lost in the wild.

2. Description of Related Art

Various kits and schemes have been proposed for providing a hiker or the like with equipment useful should the need arise when lost or disabled while hiking.

SUMMARY OF THE INVENTION

Briefly, according to the present invention, there is provided a walking stick having a shaft and a hand guard at one end of the shaft. It is an improvement that the hand guard is detachedly secured to the shaft so that it can be removed, inverted, and reattached. The hand guard has a yoke shape with two arms having spaced apart ends for receiving an elastic band therebetween. The hand guard can be positioned with the arms of the yoke extending away from the shaft so as to comprise a slingshot attachment. The walking stick, now, because of this yoke attachment, is a unique survival tool, as it becomes easy to carry an effective weapon for food and protection.

BRIEF DESCRIPTION OF THE DRAWINGS

Further features and other objects and advantages will become apparent from the following detailed description made with reference to the drawings in which.

DESCRIPTION OF THE PREFERRED EMBODIMENTS

Figure 1:
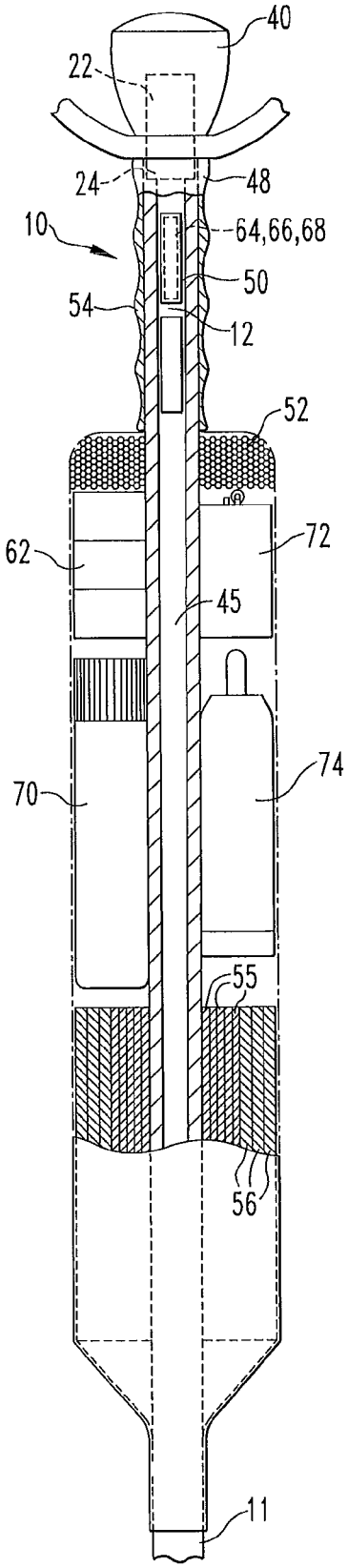
FIG. 1 is a broken away schematic section view that illustrates the manner in which various adaptations can be secured to the walking stick.

Disclosed in the drawings is a walking stick that is a practical, complete, compact survival tool. The design consists of features and adaptations that are applicable for most expanding walking sticks.

Referring to FIG. 1, there is shown a walking stick 10 with survival adaptations. The basic walking stick may have a shaft 11 that can be elongated from about two and one-half feet to four feet long. The elongation is possible because much of the walking stick shaft 11 is a hollow metal tube, the lower end of which telescopes and locks, shortening the stick or expands and locks in the walking position. Elongated or not, the walking stick shaft 11 has a hollow storage space 12 near the top of the stick. At the very top of the stick, there are internal threads 14 (see FIGS. 2 and 3) into which a cap or knob can be secured. A walking stick as just described is commercially available today.

Figure 2:
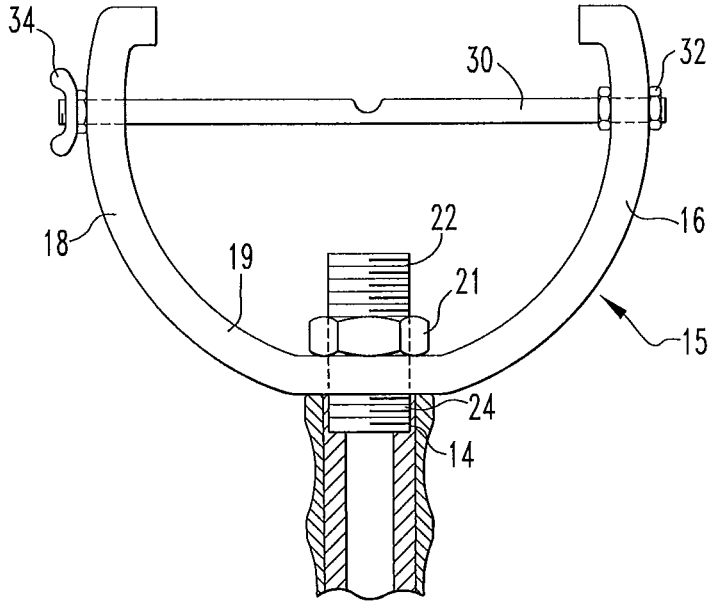
FIG. 2 is a view of the yoke or slingshot attachment extending upward from the walking stick.
Figure 3:
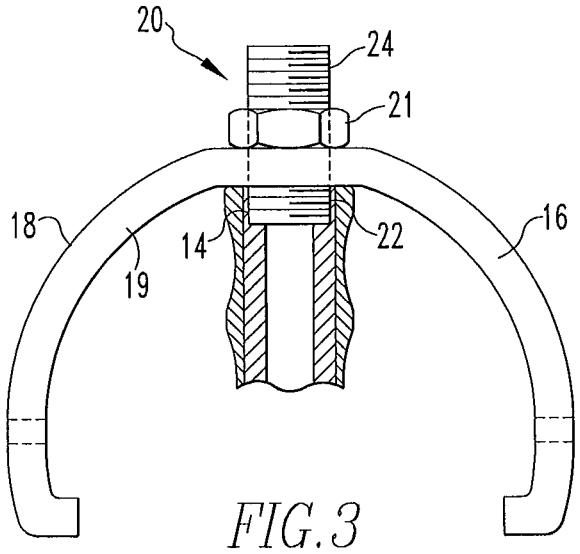
FIG. 3 is a view of the yoke or slingshot attachment in the walking or stowed position.

As shown in FIGS. 2 and 3, a unique feature of the survival walking stick according to the present invention is the shaped yoke/hand guard 15 or slingshot attachment which, when threaded into the top of the walking stick, converts it into a powerful slingshot, and when the device is not used as a slingshot, can be inverted and screwed down to become a convenient grip, as well as a hand protection shield for the survival walking stick.

This shaped yoke/hand guard 15 consists of two opposing steel arms 16, 18 rising from a base 19 attached to a center nut 21 with a vertically protruding bolt 20 with externally threaded extensions 22, 24 above and below the base allowing the shaped yoke/hand guard 15 to be screwed into the top of the survival stick. As shown in FIGS. 2 and 3, the arms and base may form a more or less continuously curved element. Each of the externally threaded extensions 22, 24 are sized to turn into the internal threads 14 thus enabling the yoke/hand guard 15 to be secured in two alternate positions on the walking stick.

Figure 4:
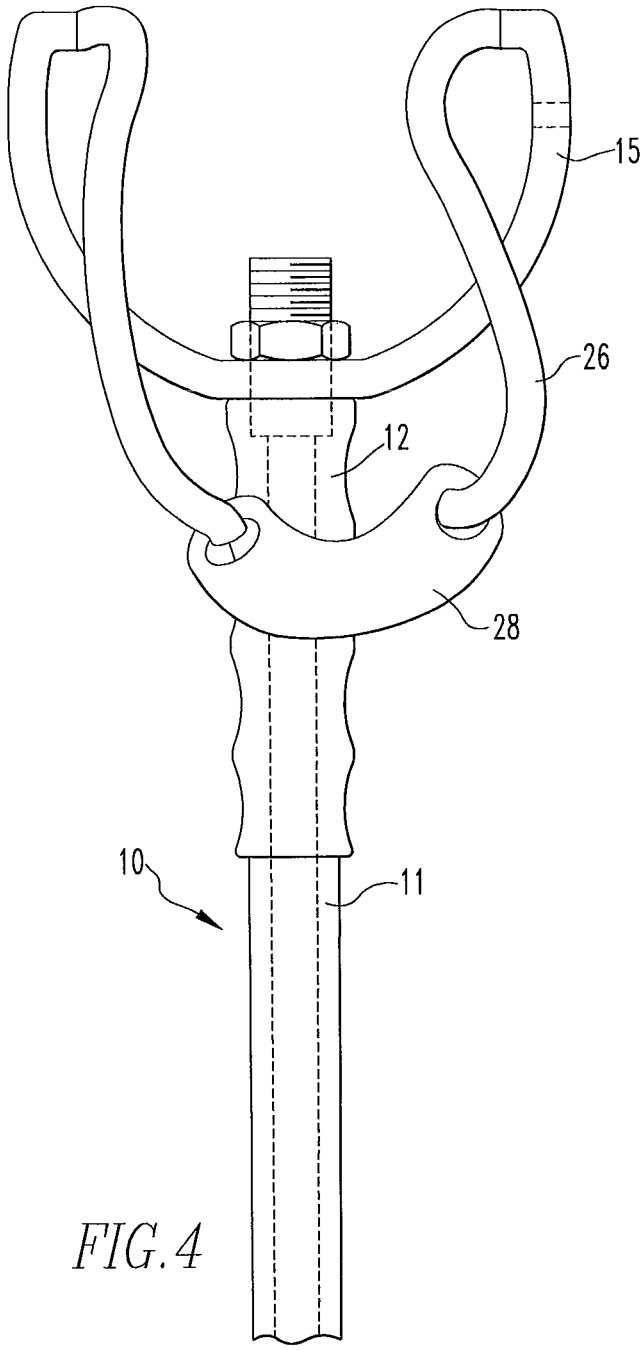
FIG. 4 is a view of the yoke or slingshot attachment with the elastic band secured between the spaced ends of the arms of the yoke.

As shown in FIG. 4, attached to the top of each steel arm is a length of rubber/plastic tubing 26 whose ends are connected by a missile pocket 28 thereby completing the sling shot. The slingshot can also be used to launch rod-like projectiles by installing a guide attachment 30 between the arms 16, 18 of the yoke. As illustrated in FIG. 2, the guide attachment 30 may be inserted though aligned holes in the arms. Near one end of the guide attachment 30 is a stop 32. The other end is threaded to receive a wing nut 34 to secure the guide attachment 30 in place. The guide attachment 30 should have a notch for receiving and guiding the launch of the rod-like projectiles.

Figure 5:
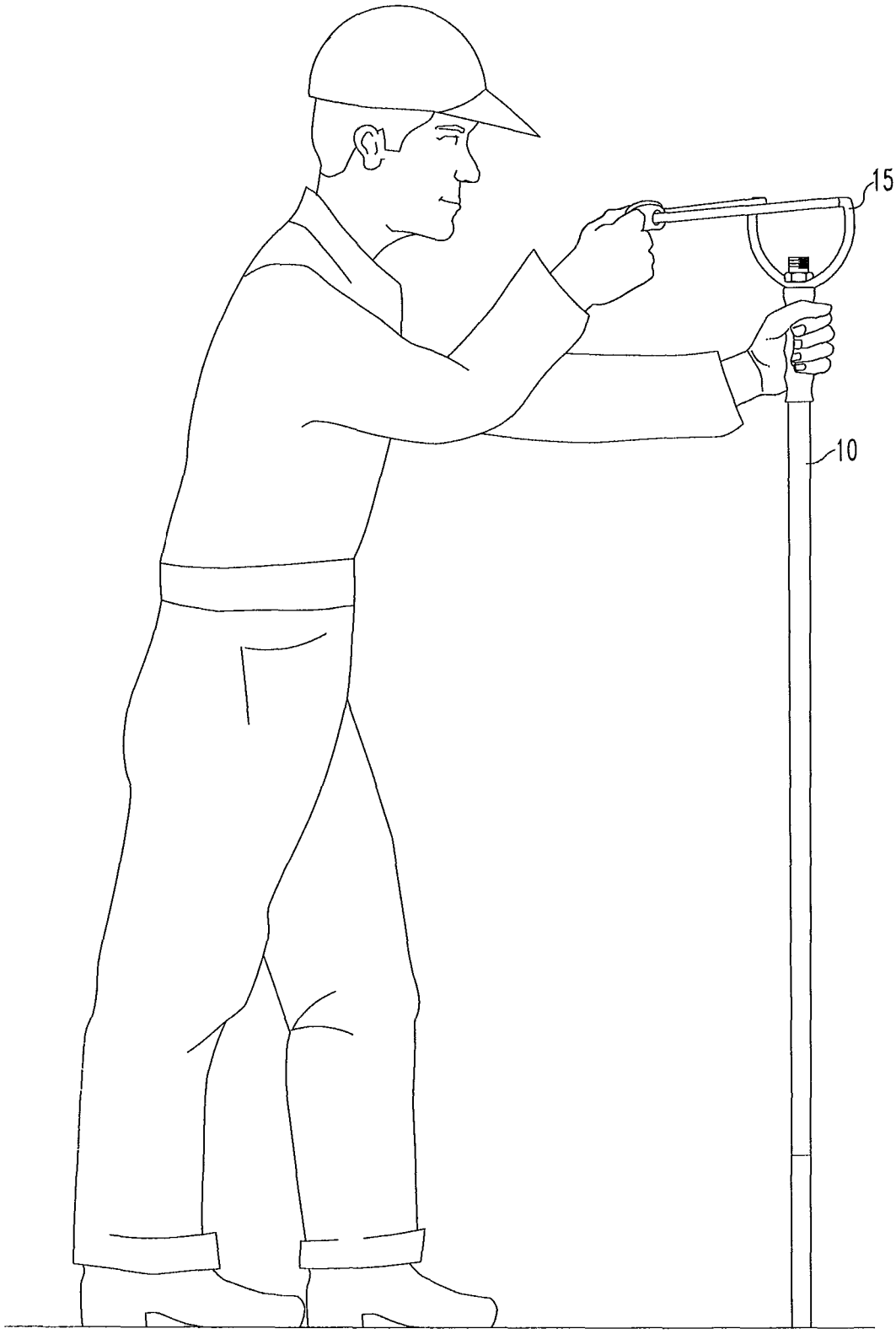
FIG. 5 illustrates an individual using the slingshot attachment on the walking stick.

As shown in FIG. 5, the survival walking stick, when extended, held planted and more or less perpendicular to the ground with one hand while the other hand stretches the rubber/plastic tubing with the loaded missile, forms a unique, powerful, accurate weapon. The above innovation is an important aspect for a complete survival tool as it becomes an easy-to-carry, effective weapon for food and protection.

Figure 6:
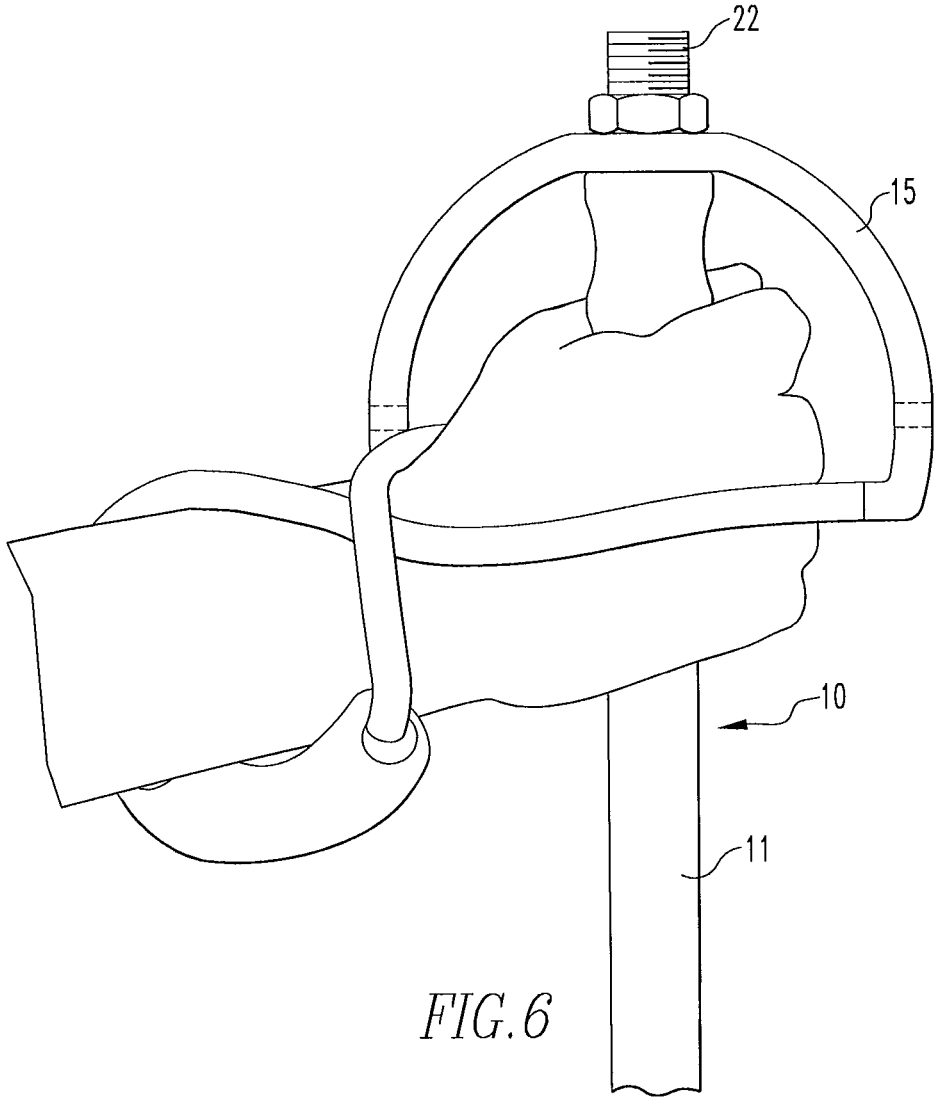
FIG. 6 illustrates the manner in which the elastic band can be wrapped around the wrist during walking to secure the walking stick from loss.

As shown in FIG. 6, when the slingshot attachment is inverted and screwed into the top of the survival walking stick, the rubber/plastic tubing 26 becomes a wrist strap. A slingshot is an excellent survival weapon as it is not necessary to collect ammunition too far in advance. Suitably sized rocks and stones are usually lying on the ground at any location.

Figure 7:
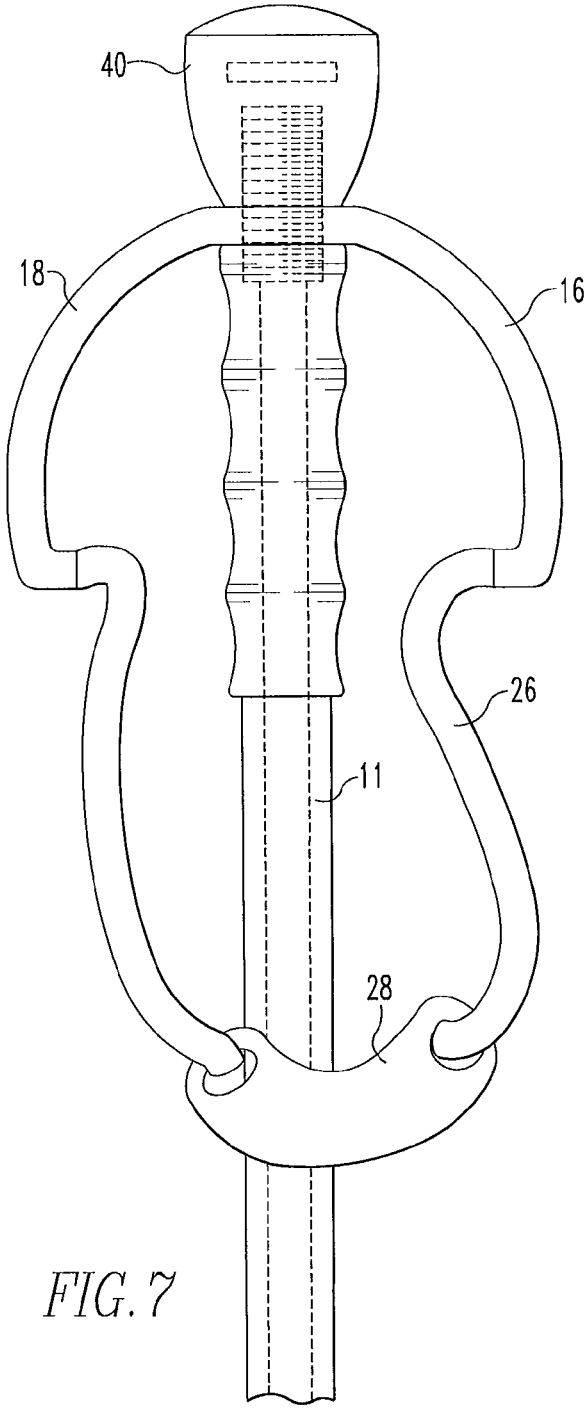
FIGS. 7 and 7A illustrate an embodiment wherein the yoke is secured to the end of the walking stick with a knob having a compass embedded therein and normally covered with a lid with a mirror on the inside of the lid.

Referring to FIG. 7, a palm rest knob 40 having a hollow space 42 therein and an internally threaded bore 45 on the bottom can be turned onto one of the externally threaded extensions 22, 24 when the yoke/hand guard 15 is turned into the shaft 11 of the walking stick 10. The hollow knob 40 has a hinged cover 43 which can be flipped open and a compass 44 inserted therein. For purposes of compass sighting, a vertical rectangular slot 46 is cut into the upper hinged cover 43 of the knob 40. The slot 46 is covered by a piece of clear plastic. The inside of the hinged cover is mirrored.

Figure 7A:
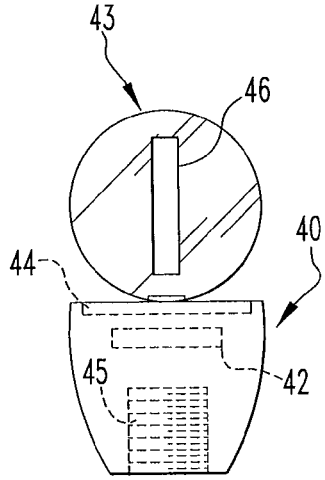

Referring to FIGS. 1, 7, and 7A, there are numerous features and adaptations included on the survival walking stick and they are listed below.

Near the top of the shaft 11 may be mounted a microcell flashlight 48. It is held in place, for example, by duct tape which is the same color as the shaft.

As already explained, the upper part of the survival walking stick has a hollow storage space 12. A smaller diameter piece of hollow plastic tubing with caps 50 can be filled with assorted items, such as a knife, blades, matches, pills, etc., and inserted into the hollow storage space of the walking stick 10.

Below the grip of the shaft may be wrapped many turns of thin gauged wire 52 covered with many wraps of duct tape 54.

At the lower portion of the grip of the shaft 11, there may be taped to the shaft 11 sheets of aluminum foil 55 wrapped on the shaft and sheets of heavy copper foil 56 wrapped over the aluminum foil 55. The copper foil 56 can be removed and shaped to form a bowl that can rest on the coals of a camp fire for boiling water or warming food. The usefulness of the copper foil 56 can be extended by lining it with the aluminum foil 55 again secured in place with duct tape 54. Packets of soft food 62 can also be secured to the shaft. The wire 52 may be used to suspend items over the fire.

Fishing line 64, hooks 66, and fire-starting material 68 may be placed in a hollow tube 50 and inserted in the hollow space 12 in the shaft 11.

Below the wrapped wire 52, there may be duct taped a 3 inch long plastic spray bottle 70 filled with insect repellant. The lid of the spray bottle is not taped and can be readily flipped open for easy access. Opposite the spray bottle is taped a fire starting tool or cigarette lighter 72, a tube of antibiotic ointment 74, and a small diameter plastic tubing with caps (not shown) filled with water purification pills.

Many of the survival items are preferably duct taped onto the survival walking stick. This tape serves two other main purposes: (1) It easily ignites so that in inclement weather a piece can be torn off for starting fires. (2) In the event of a broken or sprained limb, the duct tape can be used to bind a splint. It also would be helpful to seal deep gashes or wounds.

The survival walking stick while yet a practical aid for walking becomes a light, compact, effective survival weapon and, in addition to its many adaptations, provides many, if not most, of the items needed for survival under adverse conditions.

According to a preferred embodiment, a fabric tube having a diameter larger than the shaft of the walking stick is provided with a hole at one end that just fits over the shaft and a draw string at the other end. The fabric tube can be installed on the shaft to cover the various survival attachments on the shaft and tied in place.

Having thus disclosed my invention in the detail and particularity required by the Patent Laws, what is desired to be protected by Letters Patent is set forth in the following claims.

The invention claimed is:

1. A walking stick having a shaft and a hand guard at one end of the shaft, the improvement comprising the hand guard being detachedly secured to the shaft so that it can be removed, inverted and reattached, said hand guard having a yoke shape with two arms having spaced apart ends for receiving an elastic band therebetween, an elastic band is secured to each end of each arm of the hand guard, said hand guard being positionable with the arms of the yoke extending away from the shaft so as to comprise a slingshot and being positionable in an inverted position with the arms of the yoke extending along the exterior of the shaft.

2. The walking stick according to claim 1, having a hollow space at one end and there being an internally threaded opening into the hollow space into which external threads extending from the hand guard may be turned to secure the hand guard to the shaft.

3. A walking stick according to claim 2, in which the hand guard has a base extending between the two arms and wherein the external threads extending from the hand guard are provided on externally threaded shafts extending away from the base on either side of the base enabling the hand guard to be secured to the shaft in one of two positions.

4. A walking stick according to claim 3, having a knob with an internal bore therein such that it can be secured to the free externally threaded shaft of the hand guard when the hand guard extends away from the shaft or when the arms of the yoke extend along the exterior of the shaft.

5. A walking stick according to claim 4, wherein the knob has a compass mounted therein.

6. A walking stick according to claim 3, including a beam and means for fixing the beam across the arms of the yoke to serve as a projectile guide.

7. A walking stick according to claim 1, having heavy copper foil and aluminum foil wrapped about the shaft and secured in place by duct tape.

8. A walking stick having a shaft and a hand guard at one end of the shaft, the improvement comprising the hand guard being detachedly secured to the shaft so that it can be removed, inverted and reattached, said hand guard having a yoke shape with two arms having spaced apart ends for receiving an elastic band therebetween, said hand guard being positionable with the arms of the yoke extending away from the shaft so as to comprise a slingshot and being positionable with the arms of the yoke extending along the exterior of the shaft, said walking stick having a hollow space at one end and there being an internally threaded opening into the hollow space into which external threads extending from the hand guard may be turned to secure the hand guard to the shaft and the hand guard having a base extending between the two arms and wherein the external threads extending from the hand guard are provided on externally threaded shafts extending away from the base on either side of the base enabling the hand guard to be secured to the shaft in one of two positions.

* * * * *